US008368493B2

(12) United States Patent
Murao

(10) Patent No.: US 8,368,493 B2
(45) Date of Patent: Feb. 5, 2013

(54) LINEAR SOLENOID

(75) Inventor: Yoshiyuki Murao, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/427,013

(22) Filed: Mar. 22, 2012

(65) Prior Publication Data

US 2012/0242436 A1 Sep. 27, 2012

(30) Foreign Application Priority Data

Mar. 23, 2011 (JP) ..... 2011-63989

(51) Int. Cl.
*H01F 3/00* (2006.01)
*H01F 7/08* (2006.01)

(52) U.S. Cl. ..... 335/255; 335/261; 335/279; 335/281

(58) Field of Classification Search ..... 335/255, 335/257, 261–263, 270–271, 274, 277, 279–281
See application file for complete search history.

(56) References Cited

U.S. PATENT DOCUMENTS 7,007,925 B2 * 3/2006 Nordstrom et al. ..... 251/129.15
2004/0257185 A1 12/2004 Telep
2010/0182112 A1 7/2010 Nagasaki

* cited by examiner

*Primary Examiner* — Ramon Barrera
(74) *Attorney, Agent, or Firm* — Nixon & Vanderhye, PC

(57) ABSTRACT

A plunger main body is fixed to a shaft to reciprocate together with the shaft in an axial direction within a predetermined range. An axial overlapped surface area between a rear stator main body and the plunger main body is reduced when the plunger main body is moved from a rear stator main body side toward a front stator main body side. A plunger projection radially outwardly projects from an outer peripheral wall of an end portion of the plunger main body, which is axially located on the rear stator main body side.

2 Claims, 5 Drawing Sheets

LINEAR SOLENOID

CROSS REFERENCE TO RELATED APPLICATION

This application is based on and incorporates herein by reference Japanese Patent Application No. 2011-63989 filed on Mar. 23, 2011.

TECHNICAL FIELD

The present disclosure relates to a linear solenoid.

BACKGROUND

Use of a linear solenoid as a drive device of various apparatuses is known. For example, JP2005-45217A (corresponding to US 2004/0257185A1) teaches the use of the linear solenoid as a drive device of a valve timing control apparatus placed in an engine room of a vehicle. In this instance, a profile of the linear solenoid is reduced by reducing an axial size of the linear solenoid to enable installation of the linear solenoid in a limited space.

By reducing the profile of the linear solenoid, an axial length of a plunger is reduced. The plunger is placed on a radially inner side of a front stator and a rear stator. When a coil, which is placed on a radially outer side of the front stator and the rear stator, is energized, a magnetic force is generated. Thus, a magnetic flux flows through the rear stator, the plunger and the front stator, and thereby a magnetic attractive force is generated in the plunger. The plunger is axially displaced from the rear stator side toward the front stator side in the stroke thereof by the magnetic attractive force generated in the plunger. Here, an axial overlapped surface area (a magnetic flux transferring surface area) between the plunger and the rear stator is reduced when the amount of stroke (i.e., the amount of displacement) of the plunger is increased. Therefore, in a latter half of the stroke of the plunger, in which the amount of stroke of the plunger becomes large, the magnetic flux transferring surface area between the plunger and the rear stator becomes small, and thereby a density of the magnetic flux, which flows through the plunger and the rear stator, becomes high.

A radially outward attractive force and a negative attractive force (an attractive force, which has a vector in a direction opposite from an attracting direction of the plunger attracted toward the front stator) are generated in an end portion of the plunger, which is axially located on a side opposite from the front stator. Particularly, in the latter half of the stroke of the plunger, the density of the magnetic flux, which flow through the plunger, becomes high, so that the negative attractive force becomes large. The negative attractive force acts as a force, which pulls back the plunger in the direction opposite from the attracting direction of the plunger toward the front stator. Therefore, the negative attractive force reduces a total attractive force of the linear solenoid to cause a reduction of a magnetic efficiency. Thus, particularly, in the latter half of the stroke of the plunger, the drive force of the linear solenoid, which is applied to a drive subject to drive the same, may possibly be reduced.

In contrast, in order to improve the installability of the linear solenoid in the limited space, such as the engine room, it is desirable to further reduce the profile of the linear solenoid. When the profile of the linear solenoid is further reduced, the axial length of the plunger becomes shorter. Therefore, in the latter half of the stroke of the plunger, the density of the magnetic flux is further increased to cause an increase in the negative attractive force. As a result, the total attractive force of the linear solenoid may possibly be further reduced.

SUMMARY

The present disclosure addresses the above disadvantages. According to the present disclosure, there is provided a linear solenoid, which includes a front stator main body, a rear stator main body, a shaft, a plunger main body, a coil and a plunger projection. The front stator main body is configured into a tubular form. The rear stator main body is configured into a tubular form and is placed at a location, which is spaced from the front stator main body by a predetermined distance in an axial direction. The shaft is placed on a radially inner side of the front stator main body and the rear stator main body and is reciprocatable in the axial direction. The plunger main body is configured into a tubular form and is fixed to the shaft to enable reciprocation of the plunger main body together with the shaft in the axial direction within a predetermined range. The plunger main body and the rear stator main body are arranged such that an axial overlapped surface area between the rear stator main body and the plunger main body is reduced when the plunger main body is moved from a rear stator main body side, at which the rear stator main body is located, toward a front stator main body side, at which the front stator main body is located. The coil is placed on a radially outer side of the front stator main body and the rear stator main body. The coil generates a magnetic flux upon energization of the coil to magnetically attract the plunger main body toward the front stator main body side. The plunger projection is configured into an annular form and radially outwardly projects from an outer peripheral wall of an end portion of the plunger main body, which is axially located on the rear stator main body side.

BRIEF DESCRIPTION OF THE DRAWINGS

The drawings described herein are for illustration purposes only and are not intended to limit the scope of the present disclosure in any way.

DETAILED DESCRIPTION

Figure 1A:
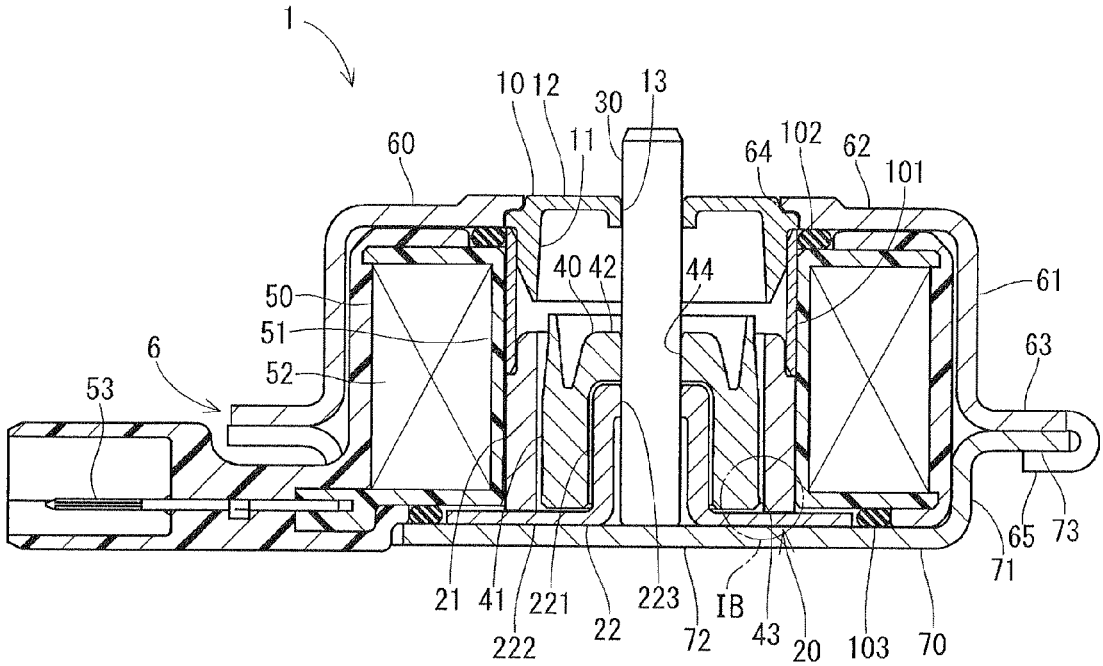
FIG. 1A is a cross-sectional view of a linear solenoid according to a first embodiment of the present disclosure.

Various embodiments of the present disclosure will be described with reference to the accompanying drawings. In the following embodiments, similar components will be indicated by the same reference numerals and will not be described redundantly for the sake of simplicity.

First Embodiment

Figure 1B:
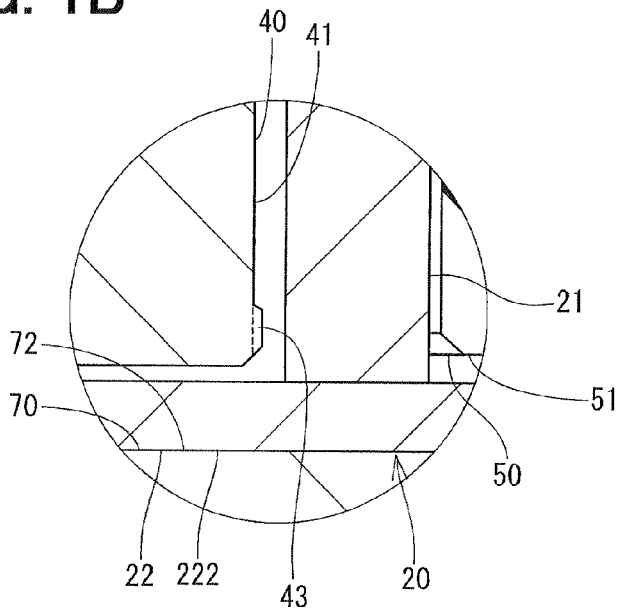
FIG. 1B is a partial enlarged view of a portion IB in FIG. 1A.

FIGS. 1A and 1B show a linear solenoid according to a first embodiment of the present disclosure. The linear solenoid 1 is implemented as a drive device of a switch valve, which switches an oil passage for conducting hydraulic oil in a valve timing control apparatus (not shown).

As shown in FIG. 1A, the linear solenoid 1 includes a front stator 10, a rear stator 20, a shaft 30, a plunger 40, a coil 50 and a housing 6.

The front stator 10 is made of a magnetic material (e.g., iron) and is configured into a cup-shaped body. The front stator 10 includes a front stator main body 11 and a support portion 12. The front stator main body 11 is configured into a tubular form, and the support portion 12 closes one end of the front stator main body 11. A hole 13 axially extends through a center part of the support portion 12.

The rear stator 20 is made of a magnetic material (e.g., iron). The rear stator 20 includes a rear stator main body 21 and a support portion 22. In the present embodiment, the rear stator main body 21 and the support portion 22 are formed separately. The rear stator main body 21 is configured into a generally cylindrical tubular form. The rear stator main body 21 is placed at a location, which is axially spaced by a predetermined distance from the front stator main body 11.

A tubular member 101, which is configured into a generally cylindrical tubular form, is fitted to an outer peripheral part of an end portion of the front stator main body 11, which is axially located on the rear stator 20 side, and also to an outer peripheral part of an end portion of the rear stator main body 21, which is axially located on the front stator 10 side. In this way, the front stator main body 11 and the rear stator main body 21 are coaxially connected together through the tubular member 101. The tubular member 101 is made of a non-magnetic material.

The support portion 22 includes a support tubular portion 221 and a plate portion 222. The support tubular portion 221 is configured into a cup-shaped body. The plate portion 222 is configured into an annular form and radially outwardly projects from an end portion of the support tubular portion 221, which is opposite from the bottom of the support tubular portion 221. A hole 223 is formed to axially extend through the bottom portion of the support tubular portion 221. The support portion 22 is placed such that a support tubular portion 221 side surface of the plate portion 222 contacts the rear stator main body 21. Thereby, a generally cylindrical space is formed between an inner peripheral wall of the rear stator main body 21 and an outer peripheral wall of the support tubular portion 221.

The shaft 30 is made of, for example, metal and is configured into a cylindrical rod form. One end portion of the shaft 30 is received through the hole 13 of the support portion 12 of the front stator 10. In this way, the hole 13 axially slidably supports the one end portion of the shaft 30. Furthermore, the other end portion of the shaft 30 is received through the hole 223 of the support tubular portion 221 of the rear stator 20. In this way, the hole 223 axially slidably supports the other end portion of the shaft 30. Specifically, the shaft 30 is axially slidably supported by the support portion 12 and the support tubular portion 221 on the radially inner side of the front stator main body 11 and the rear stator main body 21.

The plunger 40 is made of a magnetic material (e.g., iron) and is configured into a cup-shaped body. The plunger 40 includes a plunger main body 41, a bottom portion 42 and a plunger projection 43. The bottom portion 42 closes one end of the plunger main body 41, which is configured into a tubular form. A hole 44 axially extends through a center port of the bottom portion 42. The shaft 30 is press fitted into the hole 44. In this way, the bottom portion 42 of the plunger 40 is fixed to an axial middle portion of the shaft 30. Here, the plunger 40 is axially placed between the support portion 12 of the front stator 10 and the plate portion 222 of the rear stator 20. Furthermore, the plunger 40 is placed such that a portion of the plunger main body 41 is placed in the generally cylindrical space, which is formed between the inner peripheral wall of the rear stator main body 21 and the outer peripheral wall of the support tubular portion 221. As discussed above, the rear stator main body 21 is placed on the radially outer side of the plunger 40.

The plunger projection 43 is configured into an annular form and radially outwardly projects from an outer peripheral wall of an end portion of the plunger main body 41, which is located on an axial side opposite from the bottom portion 42, toward the inner peripheral wall of the rear stator main body 21 (see FIG. 1B). In the present embodiment, two opposed axial end parts of the plunger projection 43 are chamfered. Also, an outer peripheral edge of the plunger projection 43 side end portion of the plunger main body 41 is chamfered. It is desirable that an axial length of the plunger projection 43 is equal to or smaller than one half of an axial length of the plunger main body 41.

A radial wall thickness of the plunger main body 41 and the plunger projection 43 is set to be smaller than a radial distance between the outer peripheral wall of the support tubular portion 221 and the inner peripheral wall of the rear stator main body 21 in the rear stator 20. Therefore, a gap (side gap) is radially formed between the inner peripheral wall of the plunger main body 41 and the outer peripheral wall of the support tubular portion 221, and a gap (side gap) is radially formed between the plunger main body 41 and the plunger projection 43 and the inner peripheral wall of the rear stator main body 21. In this way, the plunger 40 can axially reciprocate together with the shaft 30 without contacting the support tubular portion 221 or the rear stator main body 21.

The coil 50 is placed on a radially outer side of the front stator main body 11, the tubular member 101 and the rear stator main body 21. The coil 50 includes a bobbin 51 and a winding 52. The bobbin 51 is made of resin and is configured into a generally cylindrical tubular form such that the front stator main body 11, the tubular member 101 and the rear stator main body 21 are placed on a radially inner side of the bobbin 51. The winding 52 is a copper wire and is wound around the bobbin 51. Ends of the winding 52 are connected to terminals 53, respectively. Thereby, when an electric current is supplied to the winding 52 through the terminals 53, a magnetic flux is generated at the coil 50. An outer peripheral side of the bobbin 51 and the winding 52 is molded with resin.

The housing 6 includes a front housing 60 and a rear housing 70.

The front housing 60 is made of a magnetic material (e.g., iron) and is configured into a cup-shaped body. The front housing 60 includes a tubular portion 61, a bottom portion 62 and an outer peripheral portion 63. The tubular portion 61 is configured into a tubular form. The bottom portion 62 closes one end of the tubular portion 61. The outer peripheral portion 63 is configured into an annular form and radially outwardly projects from the other end of the tubular portion 61. A hole 64 is formed in the bottom portion 62. An inner diameter of the hole 64 is substantially the same as an outer diameter of the support portion 12 of the front stator 10.

Similar to the front housing 60, the rear housing 70 is made of a magnetic material (e.g., iron) and is configured into a cup-shaped body. The rear housing 70 includes a tubular portion 71, a bottom portion 72 and an outer peripheral portion 73. The tubular portion 71 is configured into a tubular form. The bottom portion 72 closes one end of the tubular portion 61. The outer peripheral portion 73 is configured into an annular form and radially outwardly projects from the other end of the tubular portion 71.

As shown in FIG. 1A, the front housing 60 and the rear housing 70 are joined together by swaging the outer peripheral portion 63 of the front housing 60 over the outer peripheral portion 73 of the rear housing 70 such that the coil 50, the front stator 10, the tubular member 101, the rear stator 20, the plunger 40 and the shaft 30 are placed on a radially inner side of the tubular portion 61 and the tubular portion 71. Specifically, the outer peripheral portion 63 of the front housing 60 includes a plurality of claws 65, which radially outwardly project. These claws 65 are bent against the outer peripheral portion 73 of the rear housing 70 by swaging to securely connect therebetween.

As discussed above, the housing 6 receives the coil 50, the front stator 10, the tubular member 101, the rear stator 20 and the plunger 40. Specifically, the housing 6 forms an outer shell of the linear solenoid 1. As shown in FIG. 1A, the linear solenoid 1 of the present embodiment is configured into a flattened form to have a reduced axial size. Therefore, the components, such as the plunger 40, which are received in the housing 6, are configured to have the relatively short axial length.

The support portion 12 of the front stator 10 is fitted into the hole 64 of the bottom portion 62 of the front housing 60. Specifically, the support portion 12 of the front stator 10 is exposed from the bottom portion 62 of the front housing 60. Here, a radially outer part of the support portion 12 and a radially outer part (inner peripheral wall) of the hole 64 of the bottom portion 62 contact with each other. Furthermore, an opposite surface of the plate portion 222 of the rear stator 20, which is opposite from the rear stator main body 21, contacts the bottom portion 72 of the rear housing 70.

In the present embodiment, in a state before the swaging process (before the swaging of the claws 65 against the outer peripheral portion 73), the front housing 60 and the rear housing 70 form a gap of a predetermined size between the outer peripheral portion 63 of the front housing 60 and the outer peripheral portion 73 of the rear housing 70. In this way, in the swaged state (upon the swaging of the claws 65 against the outer peripheral portion 73), the axial force is exerted against the front stator 10, the tubular member 101, the rear stator main body 21 and the plate portion 222 from the bottom portion 62 of the front housing 60 and the bottom portion 72 of the rear housing 70. Thereby, the positions of the front stator 10, the tubular member 101, the rear stator main body 21 and the support portion 22 are stabilized in the inside of the housing 6.

The bottom portion 72 of the rear housing 70 can contact the other end portion of the shaft 30, which is opposite from the front stator 10. Furthermore, the support portion 12 of the front stator 10 can contact the end portion of the plunger 40, which is axially located on the front stator 10 side. Thereby, the shaft 30 is axially reciprocatable from the position, at which the shaft 30 contacts the bottom portion 72 of the rear housing 70, to the position, at which the plunger 40 contacts the support portion 12 of the front stator 10. However, in a case where a limiting member, which limits the axial movement of the shaft 30, is provided in a drive subject (the switch valve of the valve timing control apparatus in this embodiment), the plunger 40 does not contact the support portion 12 of the front stator 10.

As discussed above, the housing 6 supports the shaft 30 and the plunger 40 through the front stator 10 and the rear stator 20 in a manner that enables the axial reciprocation of the shaft 30 and the plunger 40 within a predetermined axial range.

Furthermore, in the present embodiment, an annular seal member 102 is placed between the bobbin 51 of the coil 50 and the bottom portion 62 of the front housing 60. Furthermore, an annular seal member 103 is placed between the bobbin 51 of the coil 50 and the bottom portion 72 of the rear housing 70. The seal members 102, 103 are made of a resilient material. Thereby, the seal member 102 fluid-tightly seals between the bottom portion 62 and the bobbin 51, and the seal member 103 fluid-tightly seals between the bottom portion 72 and the bobbin 51. Each of the seal members 102, 103 may be in a form of a rubber O-ring or a liquid gasket.

Next, an operation of the linear solenoid 1 will be described.

In the present embodiment, the linear solenoid 1 is implemented as the drive device of the switch valve, which switches the oil passage in the valve timing control apparatus (not shown). The switch valve includes a tubular sleeve and a spool. A plurality of holes is formed in the tubular sleeve. The spool is received in the tubular sleeve and is reciprocatable in the tubular sleeve. The switch valve switches the oil passage among a plurality of oil passages connected to the holes of the sleeve through the reciprocation of the spool in the sleeve. The linear solenoid 1 is used to drive the spool in the axial direction to reciprocate the spool.

The one end portion of the shaft 30 contacts an end portion of the spool of the switch valve. An urging member is provided between the other end portion of the spool, which is opposite from the shaft 30, and the sleeve. Thereby, the spool is urged toward the shaft 30. As a result, at the non-operating time of the linear solenoid 1, i.e., at the time of stopping the supply of the electric power to the linear solenoid 1, the shaft 30 and the plunger 40 are axially urged against the rear housing 70 (see FIG. 1A). At this time, the other end portion of the shaft 30 and the bottom portion 72 of the rear housing 70 contact with each other.

When the electric power is supplied to the linear solenoid 1 to energize the winding 52 of the coil 50, the magnetic flux is generated at the coil 50. The non-magnetic tubular member 101, which is held between the rear stator 20 and the front stator 10, limits magnetic short-circuit between the rear stator main body 21 and the front stator main body 11. Thereby, the magnetic flux, which is generated at the coil 50, flows between the rear stator 20 and the front stator 10 though the plunger 40 while bypassing the non-magnetic tubular member 101. Therefore, when the magnetic flux is generated at the coil 50, the magnetic flux flows through the rear stator 20, the plunger 40, the front stator 10, the front housing 60 and the rear housing 70 to form a magnetic circuit. Thereby, a magnetic attractive force is generated at the plunger 40, so that the plunger 40 is axially attracted toward the front stator 10 side along with the shaft 30 against the urging force of the urging member of the switch valve. As a result, the axial position of the spool in the sleeve of the switch valve is changed, and thereby the oil passage for conducting the hydraulic oil supplied to the valve timing apparatus is changed.

A limiting member, which limits the axial movement of the spool, is provided on an axial side of the spool where the urging member is placed. Therefore, the shaft 30 can be axially moved toward the switch valve side until the spool and the limiting member contact with each other. In the present embodiment, when the shaft 30 is moved to a position, at which the spool and the limiting member contact with each other, the plunger 40 and the support portion 12 of the front stator 10 do not contact with each other, and a predetermined gap is formed between the plunger 40 and the support portion 12.

Furthermore, according to the present embodiment, the electric power, which is supplied to the linear solenoid 1, is duty controlled by an undepicted electronic control unit (ECU). In this way, the attractive force for attracting the plunger 40 can be adjusted to any value. Thereby, the axial position of the spool in the sleeve of the switch valve can be adjusted to any position, so that the switching of the oil passage can be appropriately performed.

Next, the attractive force, which is generated at the plunger 40 during the operation of the linear solenoid 1 of the present embodiment, will be described with reference to FIGS. 2A and 2B.

Figure 2A:
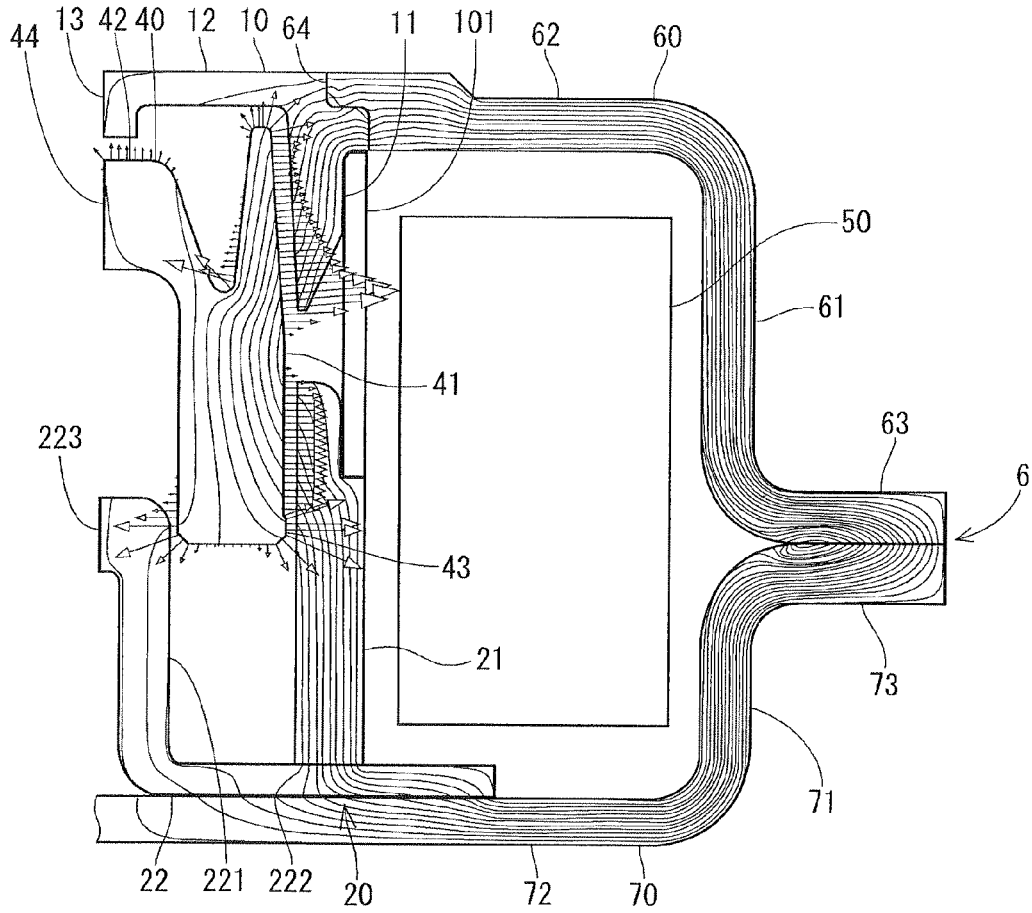
FIG. 2A is a schematic diagram showing a magnetic flux, which flows in the linear solenoid, and an attractive force, which is generated in a plunger of the linear solenoid, according to the first embodiment.

FIG. 2A shows the flow of the magnetic flux in a state where the plunger 40 is axially attracted toward the front stator 10 side upon supplying of a predetermined electric current to the coil 50. In this instance, the plunger 40 is placed in a forward end stroke position, which is closest to the front stator 10 in the axial movable range (stroke range) of the plunger 40. At this time, an overlapped surface area (a surface area of an axially overlapped surface) between the plunger main body 41 and the rear stator main body 21, i.e., a magnetic flux transferring surface area between the plunger main body 41 and the rear stator main body 21 is small, so that a density of the magnetic flux in this magnetic flux transferring surface area is high.

Figure 2B:
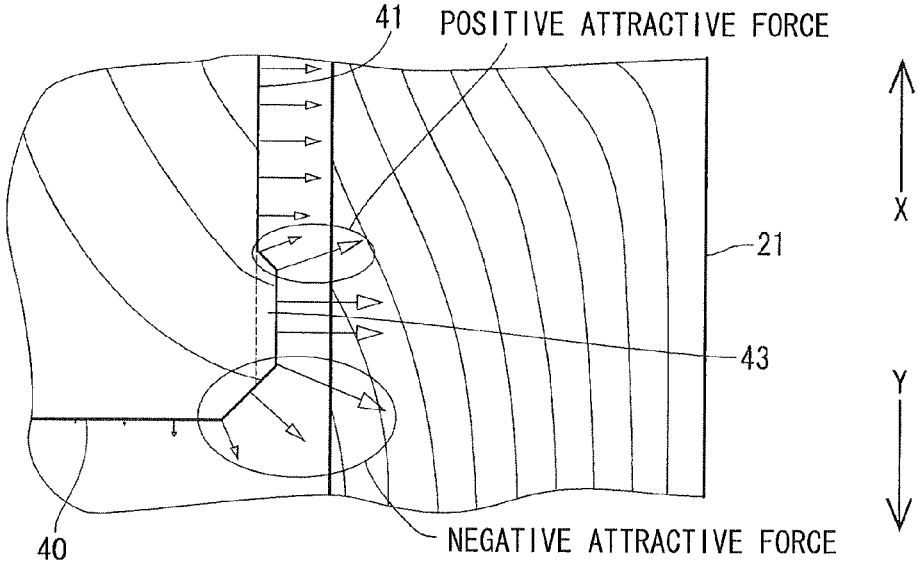
FIG. 2B is a partial enlarged view showing an end portion of the plunger axially located on a rear stator side according to the first embodiment.

Here, when the end portion of the plunger main body 41, which is axially located on the plate portion 222 side (see FIG. 2B), is viewed, it is noted that a radially outward attractive force and a negative attractive force (an attractive force, which has a vector that is in a direction, i.e., a direction of an arrow Y in FIG. 2B that is opposite from the attracting direction of the plunger 40 attracted through the energization of the coil 50) are generated in the end portion of the plunger main body 41, which is axially located on the plate portion 222 side. This negative attractive force pulls back the plunger 40 in the direction, which is opposite from the attracting direction of the plunger 40 attracted through the energization of the coil 50. Therefore, the negative attractive force reduces the total attractive force of the entire linear solenoid 1 to cause a reduction of the magnetic efficiency.

In the present embodiment, as discussed above, the plunger 40 has the plunger projection 43, which is the annular projection and radially outwardly projects from the end portion of the plunger main body 41 that is axially located on the plate portion 222 side. With reference to FIG. 2B, an attractive force, which has a vector in the attracting direction (a direction of an arrow X in FIG. 2B) of the plunger 40 attracted through the energization of the coil 50, is generated in the end part of the plunger projection 43, which is axially located on the front stator 10 side. That is, a positive attractive force is generated in the end part of the plunger projection 43, which is axially located on the front stator 10 side. The positive attractive force is applied in the direction of cancelling the negative attractive force. Therefore, in the present embodiment, the reduction of the total attractive force of the entire linear solenoid 1 caused by the negative attractive force is limited by the positive attractive force.

Figure 3A:
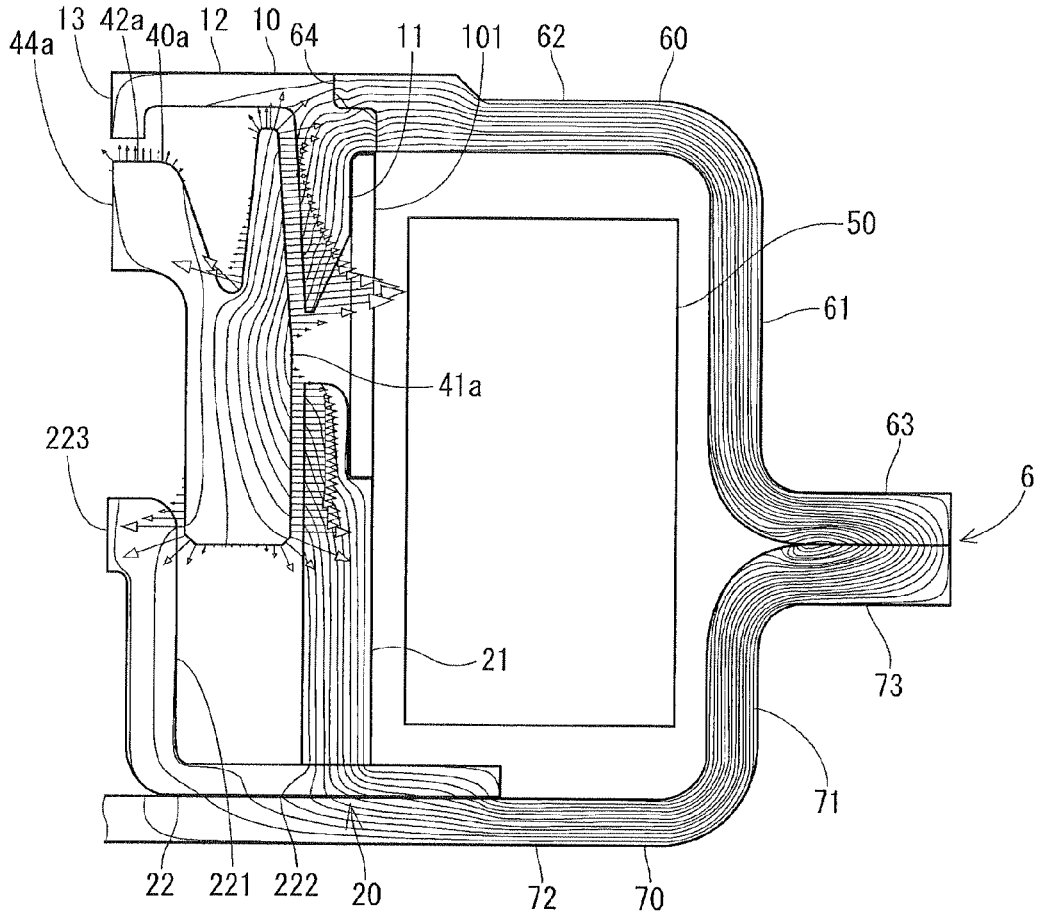
FIG. 3A RELATED ART
FIG. 3A is a schematic diagram showing a magnetic flux, which flows in a linear solenoid of a comparative example, and an attractive force, which is generated in a plunger of the linear solenoid of the comparative example.

Next, with reference to FIGS. 3A and 3B, there will be described an attractive force, which is generated in a plunger 40*a* of a comparative example that includes a plunger main body 41*a* and a bottom portion 42*a* having a hole 44*a*, which are similar to the plunger main body 41 and the bottom portion 42 of the present embodiment. However, the plunger 40*a* of the comparative example does not have the plunger projection 43 of the plunger 40 of the present embodiment. Other than the absence of the plunger projection 43 in the plunger 40*a* of the comparative example, the rest of the structure of the comparative example is substantially the same as that of the present embodiment shown in FIGS. 2A and 2B. Therefore, the other components of the comparative example other than the plunger 40*a* are indicated by the same reference numerals as those indicated in FIGS. 2A and 2B. Specifically, the comparative example has the structure, which is similar to that of the linear solenoid of JP2005-45217A (corresponding to US 2004/0257185A1). FIG. 3A shows the flow of the magnetic flux in a state where the plunger 40*a* is axially attracted toward the front stator 10 side upon supplying of a predetermined electric current to the coil 50. In this instance, the plunger 40*a* is placed in the forward stroke end position, which is closest to the front stator 10 in the axial movable range of the plunger 40*a*.

Figure 3B:
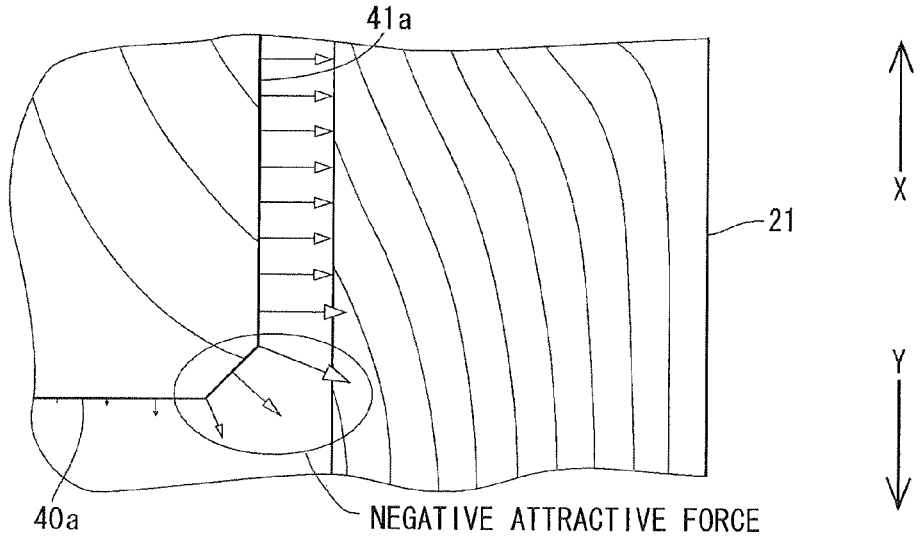
FIG. 3B RELATED ART
FIG. 3B is a partial enlarged view showing an end portion of the plunger axially located on a rear stator side in the comparative example shown in FIG. 3A.

Here, when the end portion of the plunger main body 41*a*, which is axially located on the plate portion 222 side (see FIG. 3B), is viewed, it is noted that a radially outward attractive force and a negative attractive force (an attractive force, which has a vector that is in a direction, i.e., a direction of an arrow Y in FIG. 3B that is opposite from the attracting direction of the plunger 40 attracted through the energization of the coil 50) are generated in the end portion of the plunger main body 41, which is axially located on the plate portion 222 side.

In the comparative example, the plunger 40*a* does not have the plunger projection 43 of the present embodiment. Therefore, the attractive force, which has the vector in the attracting direction (a direction of an arrow X in FIG. 3B) of the plunger 40*a* attracted through the energization of the coil 50, is not generated in the end portion of the plunger main body 41*a*, which is axially located on the plate portion 222 side. That is, the positive attractive force is not generated in the end portion of the plunger main body 41*a*, which is axially located on the plate portion 222 side (see FIG. 3B). Therefore, in the comparative example, the total attractive force of the entire linear solenoid is reduced in comparison to that of the present embodiment.

Figure 4A:
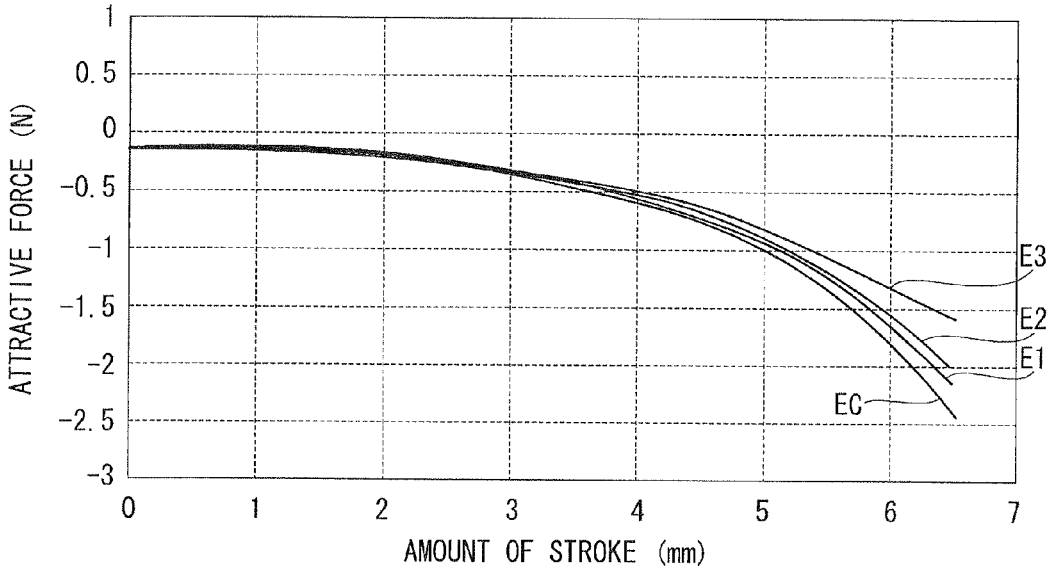
FIG. 4A is a graph showing a relationship between the amount of stroke of the plunger and the attractive force generated in the plunger for each of the first to third embodiments of the present disclosure and the comparative example.
Figure 4B:
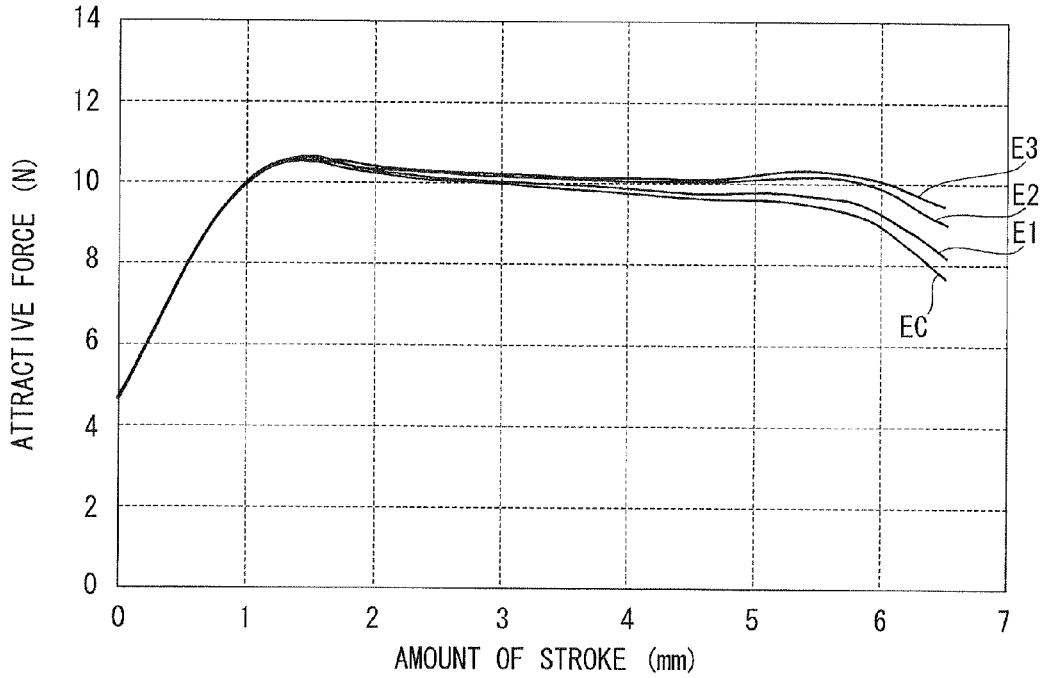
FIG. 4B is a graph showing a relationship between the amount of stroke of the plunger and a total attractive force of the entire plunger for each of the first to third embodiments of the present disclosure and the comparative example.

FIGS. 4A and 4B show results of experiments with respect to the attractive force generated in the plunger 40 of the present embodiment and the attractive force generated in the plunger 40*a* of the comparative example.

FIG. 4A shows a relationship between the amount of stroke (i.e., the amount of displacement) of the plunger 40, 40*a* and the total amount of attractive force generated in the end portion of the plunger 40, 40*a*, which is axially located on the plate portion 222 side, at the time of applying a predetermined electric current (e.g., the electric current of 1 ampere) to the coil 50 and thereby displacing the plunger 40, 40*a* in the stroke thereof toward the front stator 10 side through the magnetic attraction. In this discussion, the amount of stroke of the plunger 40, 40*a* is a distance between a position (reference position: 0) of the plunger 40, 40*a* held in the state where the shaft 30 contacts the bottom portion 72 of the rear housing 70, and a position of the plunger 40, 40*a* upon axial displacement thereof.

Furthermore, the end portion of the plunger 40, 40*a*, which is axially located on the plate portion 222 side, refers to the portion of the plunger 40, 40*a* shown in FIG. 2B or 3B. Furthermore, the total amount of attractive force refers to the total amount of axial vectors in the attractive force generated at the plunger 40, 40*a*. Therefore, in a case where the total amount of attractive fore is a positive value, it indicates the generation of the attractive force (the positive attractive force), which attracts the plunger 40, 40*a* toward the front stator 10 side. In contrast, in a case where the total amount of attractive force is a negative value, it indicates the generation of the pulling force (the negative attractive force), which pulls back the plunger 40, 40*a* toward the plate portion 222 side.

FIG. 4B shows a relationship between the amount of stroke of the plunger 40, 40*a* and the total of attractive force (total amount of attractive force) generated in the entire linear solenoid 1, i.e., in the entire plunger 40 at the time of applying the predetermined electric current (e.g., the electric current of 1 ampere) to the coil 50 and thereby displacing the plunger 40, 40*a* toward the front stator 10 side through the magnetic attraction.

In FIGS. 4A and 4B, a line E1 indicates the result of the experiment for the linear solenoid of the present embodiment, and a line EC indicates the result of the experiment for the linear solenoid of the comparative example. In view of the results of the experiments of FIG. 4A, it should be understood that the negative attractive force of the present embodiment is reduced throughout the entire stroke range of the plunger 40 in comparison to the comparative example. Particularly, it is understood that a ratio of reduction in the negative attractive force is large in the state where the amount of stoke of the plunger 40, 40*a* is large, i.e., in the latter half of the stroke of the plunger 40, 40*a*. The ratio of reduction in the negative attractive force of the present embodiment relative to that of the comparative example is about 12% at the forward end stroke position of the plunger 40, 40*a*, which is closest to the front stator 10 in the movable range (stroke range) of the plunger 40, 40*a*.

Furthermore, in view of the results of the experiments of FIG. 4B, it should be understood that the total attractive force of the entire linear solenoid 1 of the present embodiment is increased, i.e., is improved in the entire stroke range of the plunger 40 in comparison to that of the comparative example. Particularly, the ratio of improvement of the attractive force is large in the latter half of the stroke of the plunger 40 according to the present embodiment.

As discussed above, according to the present embodiment, the plunger projection 43 of the plunger 40 is configured into the annular form and radially outwardly projects from the outer peripheral wall of the end portion of the plunger main body 41, which is axially located on the rear stator main body 21 side.

In the present embodiment, when the magnetic flux is generated at the coil 50, the magnetic flux flows through the rear stator 20, the plunger 40, the front stator 10, the front housing 60 and the rear housing 70 to form the magnetic circuit. In this way, the magnetic attractive force is generated at the plunger 40, and thereby the plunger 40 is magnetically attracted toward the front stator 10 side. The plunger 40 is displaced toward the front stator 10 side within the predetermined axial range when the plunger 40 is magnetically attracted upon the energization of the coil 50. When the plunger 40 is in the latter half of the stroke of the plunger 40, i.e., when the plunger 40 is placed adjacent to the support portion 12 of the front stator 10, the overlapped surface area between the plunger main body 41 and the rear stator main body 21 becomes small, so that the density of the magnetic flux, which flows through the plunger 40 and the rear stator 20, becomes high.

During the stroke of the plunger 40, the radially outward attractive force and the negative attractive force (the attractive force, which has the vector that is in the direction opposite from the attracting direction of the plunger 40 attracted through the energization of the coil 50) are generated in the end portion of the plunger 40, which is axially located on the rear stator main body 21 side. According to the present embodiment, as discussed above, the plunger 40 has the plunger projection 43, which is configured into the annular form and radially outwardly projects from the outer peripheral wall of the end portion of the plunger main body 41, which is axially located on the rear stator main body 21 side. With this construction, when the plunger 40 is attracted during its stroke toward the front stator 10 side through the energization of the coil 50, the positive attractive force (the attractive force in the attracting direction of the plunger 40 attracted through the energization of the coil 50) is generated on the front stator 10 side end part of the plunger projection 43. The positive attractive force is applied in the direction of cancelling the negative attractive force. Therefore, even when the negative attractive force is generated in the end portion of the plunger 40 on the axial side opposite from the front stator 10, it is possible to limit or minimize the reduction in the total attractive force of the entire linear solenoid 1 caused by the negative attractive force.

In the present embodiment, particularly in the latter half of the stroke of the plunger 40, the density of the magnetic flux, which flows through the plunger 40 and the rear stator 20, becomes high to cause the increase in the negative attractive force, thereby possibly resulting in the decrease in the total attractive force of the entire linear solenoid 1. However, with the above-described construction of the present embodiment, it is possible to limit or minimize the reduction in the total attractive force of the entire linear solenoid 1 particularly in the latter half of the stroke of the plunger 40 because of the increase in the positive attractive force, which occurs simultaneously with the increase in the negative attractive force. Therefore, the linear solenoid 1 of the present embodiment can achieve the generally flat characteristic with respect to the attractive force of the plunger 40 (the plunger main body 41) throughout the entire range of the stroke of the plunger 40 (the plunger main body 41).

Second Embodiment

Figure 5:
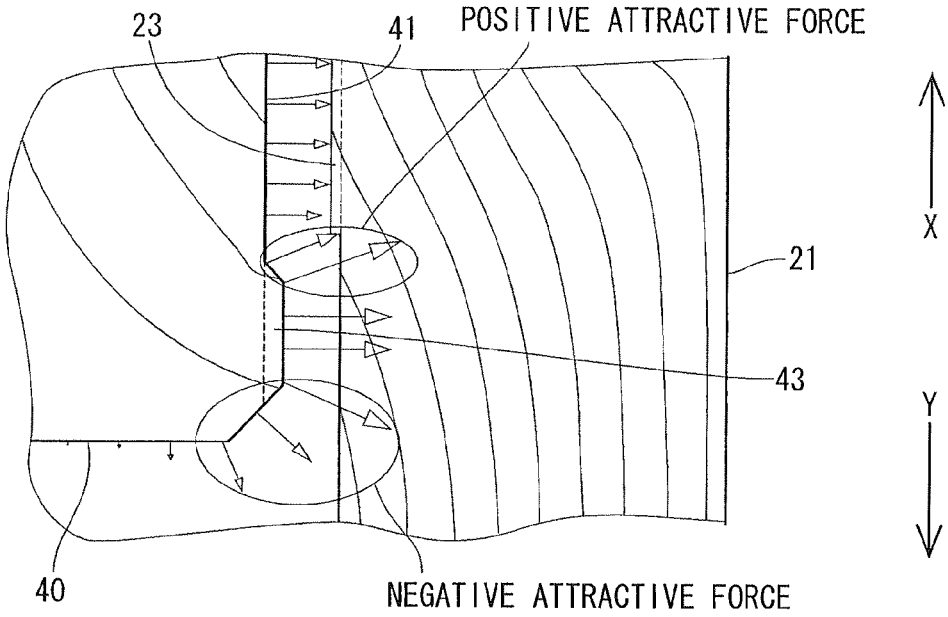
FIG. 5 is a schematic diagram showing a magnetic flux, which flows in a linear solenoid of the second embodiment, and an attractive force, which is generated in an end portion of a plunger axially located on a rear stator side.

FIG. 5 shows a portion of a linear solenoid according to a second embodiment of the present disclosure. In the second embodiment, the configuration of the rear stator main body 21 of the rear stator 20 differs from that of the first embodiment.

FIG. 5 shows the flow of the magnetic flux at the time of attracting the plunger 40 toward the front stator 10 side upon supplying the predetermined electric current to the coil 50 of the linear solenoid 1 according to the second embodiment. In this instance, the plunger 40 is placed in the forward end stroke position, which is closest to the front stator 10 in the axial movable range of the plunger 40.

As shown in FIG. 5, in the present embodiment, the rear stator 20 has a rear stator projection 23, which is configured into an annular form and radially inwardly projects from an inner peripheral wall of an end portion of the rear stator main body 21, which is axially located on the front stator main body 11 side. In the present embodiment, the plunger projection 43 of the plunger 40 and the rear stator projection 23 of the rear stator 20 are formed such that the plunger projection 43 and the rear stator projection 23 do not overlap with each other in the axial direction (i.e., an axial extent of the plunger projection 43 and an axial extent of the rear stator projection 23 being not overlapped with each other) even when the plunger 40 is placed in the forward end stroke position thereof, which is closest to the front stator 10 in the movable range (stoke range) of the plunger 40 (see FIG. 5).

With reference to FIG. 5, it should be understood that the positive attractive force, which is generated in the front stator 10 side end part of the plunger projection 43, is increased in comparison to that of the first embodiment.

A line E2 in each of FIGS. 4A and 4B shows the result of the experiments for the linear solenoid of the second embodiment performed under the same condition as that of the first embodiment and the comparative example. In view of the results of the experiments of FIG. 4A, it should be understood that the negative attractive force of the present embodiment is reduced throughout the entire stroke range of the plunger 40 in comparison to the comparative example and the first embodiment. Particularly, it is understood that the ratio of reduction in the negative attractive force is large in the state where the amount of stoke of the plunger 40, 40*a* is large, i.e., in the latter half of the stroke of the plunger 40. The ratio of reduction in the negative attractive force of the present embodiment relative to that of the comparative example is about 23% at the forward end stroke position of the plunger 40, which is closest to the front stator 10 in the movable range (stroke range) of the plunger 40.

Furthermore, in view of the results of the experiments of FIG. 4B, it should be understood that the total attractive force of the entire linear solenoid 1 of the present embodiment is increased, i.e., is improved in the entire stroke range of the plunger 40 in comparison to that of the comparative example and that of the first embodiment. Particularly, the ratio of improvement of the attractive force is large in the latter half of the stroke of the plunger 40 according to the present embodiment.

As discussed above, in the present embodiment, the rear stator 20 has the rear stator projection 23, which is configured into the annular form and radially inwardly projects from the inner peripheral wall of the end portion of the rear stator main body 21, which is axially located on the front stator main body 11 side. With this construction, when the plunger 40 is attracted during its stroke toward the front stator 10 side through the energization of the coil 50, particularly in the latter half of the stroke of the plunger 40, a distance between the plunger projection 43 of the plunger 40 and the rear stator projection 23 of the rear stator 20 becomes small. Thereby, it is possible to increase the positive attractive force, which is generated in the front stator 10 side end part of the plunger projection 43. As a result, it is possible to further effectively limit the reduction in the total attractive force of the entire linear solenoid caused by the negative attractive force.

Third Embodiment

Figure 6:
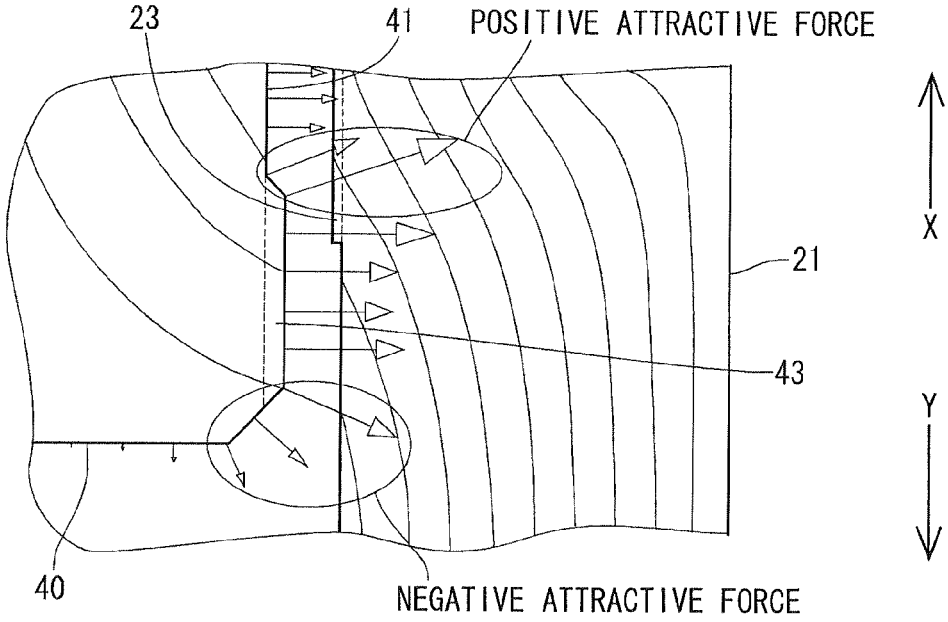
FIG. 6 is a schematic diagram showing a magnetic flux, which flows in a linear solenoid of the third embodiment, and an attractive force, which is generated in an end portion of a plunger axially located on a rear stator side.

FIG. 6 shows a portion of a linear solenoid according to a third embodiment of the present disclosure. In the third embodiment, the configuration of the plunger projection 43 of the plunger 40 differs from that of the second embodiment shown in FIG. 5.

FIG. 6 shows the flow of the magnetic flux at the time of attracting the plunger 40 toward the front stator 10 side upon supplying the predetermined electric current to the coil 50 of the linear solenoid 1 according to the third embodiment. In this instance, the plunger 40 is placed in a forward end stroke position, which is closest to the front stator 10 in the axial movable range (stroke range) of the plunger 40.

As shown in FIG. 6, in the present embodiment, the axial length of the plunger projection 43 of the plunger 40 is increased toward the front stator 10 side in comparison to that of the second embodiment. Therefore, in the present embodiment, when the plunger 40 is placed in the forward end stroke position, which is closest to the front stator 10 in the movable range (stroke range) of the plunger 40, the plunger projection 43 of the plunger 40 and the rear stator projection 23 of the rear stator 20 are overlapped with each other in the axial direction (i.e., an axial extent of the plunger projection 43 and an axial extent of the rear stator projection 23 being overlapped with each other). In other words, in the present embodiment, the plunger projection 43 of the plunger 40 and the rear stator projection 23 of the rear stator 20 are formed to overlap with each other in the axial direction when the plunger 40 is placed in the forward end stroke position, which is closest to the front stator 10 in the movable range (stroke range) of the plunger 40 (see FIG. 6). Desirably, an axial extent of the overlapped surface area between the plunger projection 43 of the plunger 40 and the rear stator projection 23 of the rear stator 20 is set to be equal to or smaller than one half of the axial length of the plunger projection 43.

With reference to FIG. 6, it should be understood that the positive attractive force, which is generated in the front stator 10 side end part of the plunger projection 43, is increased in comparison to that of the second embodiment.

A line E3 in each of FIGS. 4A and 4B shows the result of the experiments for the linear solenoid of the third embodiment performed under the same condition as that of the first and second embodiments and the comparative example. In view of the results of the experiments of FIG. 4A, it should be understood that the negative attractive force of the present embodiment is reduced throughout the entire stroke range of the plunger 40 in comparison to the comparative example and the first and second embodiments. Particularly, it is understood that the ratio of reduction in the negative attractive force is large in the state where the amount of stoke of the plunger 40 is large, i.e., in the latter half of the stroke of the plunger 40. The ratio of reduction in the negative attractive force of the present embodiment relative to that of the comparative example is about 55% at the forward end stroke position of the plunger 40, which is closest to the front stator 10 in the movable range (stroke range) of the plunger 40.

Furthermore, in view of the results of the experiments of FIG. 4B, it should be understood that the total attractive force of the entire linear solenoid 1 of the present embodiment is increased, i.e., is improved in the entire stroke range of the plunger 40 in comparison to that of the comparative example and that of the first and second embodiments. Particularly, the ratio of improvement of the attractive force is large in the latter half of the stroke of the plunger 40 according to the present embodiment.

As discussed above, in the present embodiment, the plunger projection 43 of the plunger 40 and the rear stator projection 23 of the rear stator 20 are formed to overlap with each other in the axial direction when the plunger 40 is placed in the forward end stroke position, which is closest to the front stator 10 in the movable range (stroke range) of the plunger 40. With this construction, when the plunger 40 is attracted during its stroke toward the front stator 10 side through the energization of the coil 50, particularly in the latter half of the stroke of the plunger 40, the distance between the plunger projection 43 of the plunger 40 and the rear stator projection 23 of the rear stator 20 becomes smaller in comparison to that of the second embodiment. In this way, it is possible to reduce a gap (side gap) between the outer peripheral wall of the front stator 10 side end part of the plunger projection 43 of the plunger 40 and the inner peripheral wall of the rear stator projection 23 of the rear stator 20. Therefore, particularly in the latter half of the stroke of the plunger 40, the positive attractive force, which is generated at the front stator 10 side end part of the plunger projection 43, can be further increased. As a result, it is possible to further effectively limit the reduction in the total attractive force of the entire linear solenoid caused by the negative attractive force.

The above embodiments may be modified as follows.

In the above embodiments, the rear stator main body and the support portion of the rear stator are formed separately. Alternatively, the rear stator main body and the support portion of the rear stator may be formed integrally.

The application of the present disclosure is not limited to the drive device that drives the switch valve of the valve timing control apparatus. That is, the present disclosure may be applied to a drive device of any other suitable type of apparatus or device.

As discussed above, the present disclosure is not limited to the above embodiments, and the above embodiments may be modified within the spirit and scope of the present disclosure.

What is claimed is:

1. A linear solenoid comprising:

a front stator main body that is configured into a tubular form;

a rear stator main body that is configured into a tubular form and is placed at a location, which is spaced from the front stator main body by a predetermined distance in an axial direction;

a shaft that is placed on a radially inner side of the front stator main body and the rear stator main body and is reciprocatable in the axial direction;

a plunger main body that is configured into a tubular form and is fixed to the shaft to enable reciprocation of the plunger main body together with the shaft in the axial direction within a predetermined range, wherein the plunger main body and the rear stator main body are arranged such that an axial overlapped surface area between the rear stator main body and the plunger main body is reduced when the plunger main body is moved from a rear stator main body side, at which the rear stator main body is located, toward a front stator main body side, at which the front stator main body is located;

a coil that is placed on a radially outer side of the front stator main body and the rear stator main body, wherein the coil generates a magnetic flux upon energization of the coil to magnetically attract the plunger main body toward the front stator main body side;

a plunger projection that is configured into an annular form and radially outwardly projects from an outer peripheral wall of an end portion of the plunger main body, which is axially located on the rear stator main body side; and a rear stator projection that is configured into an annular form and radially inwardly projects from an inner peripheral wall of an end portion of the rear stator main body, which is axially located on the front stator main body side.

2. The linear solenoid according to claim 1, wherein the plunger projection and the rear stator projection are formed such that the plunger projection and the rear stator projection overlap with each other in the axial direction when the plunger main body is placed in a position, which is closest to the front stator main body within the predetermined range.

* * * * *